US009863720B2

(12) United States Patent
Wells et al.

(10) Patent No.: US 9,863,720 B2
(45) Date of Patent: Jan. 9, 2018

(54) COOLING PAD SUPPORT ASSEMBLIES

(71) Applicants: Ray Wells, Timpson, TX (US); Chuck Walker, Lufkin, TX (US); Allen Loggins, Jr., Lufkin, TX (US)

(72) Inventors: Ray Wells, Timpson, TX (US); Chuck Walker, Lufkin, TX (US); Allen Loggins, Jr., Lufkin, TX (US)

(73) Assignee: Ray Wells, Timpson, TX (US)

( * ) Notice: Subject to any disclaimer, the term of this patent is extended or adjusted under 35 U.S.C. 154(b) by 0 days.

(21) Appl. No.: 14/561,539

(22) Filed: Dec. 5, 2014

(65) Prior Publication Data

US 2017/0299282 A1 Oct. 19, 2017

(51) Int. Cl.
*F24F 6/04* (2006.01)
*F28F 9/007* (2006.01)
*A47B 46/00* (2006.01)

(52) U.S. Cl.
CPC ..... *F28F 9/0075* (2013.01); *A47B 46/005* (2013.01)

(58) Field of Classification Search
CPC ... F24F 6/04; F28C 3/08; Y10S 261/41; F28F 9/0075; A47B 46/005
USPC ..... 261/103, 106
See application file for complete search history.

(56) References Cited

U.S. PATENT DOCUMENTS 3,047,994 A * 8/1962 Le Brun ..... B01D 46/10 261/DIG. 41
3,150,945 A * 9/1964 Baggeson ..... B01D 46/10 210/485
4,354,985 A * 10/1982 Johnson ..... F24F 6/04 126/113
4,428,890 A * 1/1984 Harrell ..... F24F 6/04 261/106
4,672,820 A * 6/1987 Goettl ..... F24F 6/04 261/106
5,540,867 A * 7/1996 DeBello ..... F28F 25/087 261/112.1
5,765,544 A * 6/1998 Vigansky, Jr. ..... B60H 3/022 126/110 AA
6,149,701 A * 11/2000 Ellingson ..... B01D 46/0005 55/385.1
6,206,348 B1 * 3/2001 Imsdahl ..... F02C 7/143 261/103
7,350,364 B2 * 4/2008 Meerpohl ..... A01K 1/0082 62/310

* cited by examiner

*Primary Examiner* — Charles Bushey

(57) ABSTRACT

A cooling pad support system for holding a cooling pad may include a support array; a pivoting platform configured to be pivotably connected with respect to the support array and a support finger configured to be pivotably connected to the pivoting platform. The cooling pad may be sandwiched between the support finger and support array.

3 Claims, 5 Drawing Sheets

COOLING PAD SUPPORT ASSEMBLIES

FIELD OF THE INVENTION

The present invention relates to water distribution systems, and more particularly to cooling pad support assemblies and systems for use with evaporative cooling pads.

BACKGROUND

Evaporative cooling is a well-known technique in which water is passed in a cross or counter current relationship to air over an evaporative cooling medium.

The most common water distribution system used in evaporative cooling systems is a pipe with spray nozzles directing water upwardly into a cover of a general dome or semi-cylindrical shape. The cover or dome deflects the water downwardly into top of the cooling pad.

U.S. Pat. No. 4,389,352 discloses a support assembly for water evaporative cooling systems of the type that are used in greenhouses, poultry houses and livestock installations. Such cooling systems are installed within one or more of the walls of the building and utilize water soaked pads. The outside air is cooled as it passes into the building through a water soaked pad because of vaporization of the water. A pump is employed to supply water at controlled rates to a drip conductor positioned above the pad. The water drips downwardly from the conductor through the pad soaking same. Simultaneously, exhaust fans installed within the walls of the building create a negative pressure therein causing outside air to pass through the water soaked pad into the building thereby effecting the desired cooling of the incoming air. Excess water is collected below the pad in a gutter and thereafter pumped back to the drip conductor to continue the cooling operation.

Different types of support assemblies for water evaporation cooling pads are known in the art, for example:

U.S. Pat. No. 2,850,269 discloses a cooling pad hanger system comprising a top horizontal drip conductor having a cover and large drip orifices along its bottom, a hanger strip of sheet metal extending downwardly from the drip conductor along its rear, and a return drip collector under the cooling pads having flanges which hold frames surrounding the pads and catch descending water.

U.S. Pat. No. 2,268,540, discloses a furnace evaporative cooling unit having a water conduit surrounded partially by a cover. After running down the sides of the cooling pad, which is supported only at its lower corners, the water is captured by a water tank, one side of which has an outwardly extending flange.

U.S. Pat. No. 4,031,180 discloses an evaporation cooling system including a top cover over a water conductor, cooling pads and a bottom gutter. The top cover contains pad cover brackets provided with retainers located on opposite sides of the water conductor which terminate in flanges that hold the pads. A pan in the bottom gutter is provided with many openings and the flat bottoms of the cooling pads rest on the flat pan above these openings.

While such prior art support assemblies for evaporative cooling systems provide a means for cooling agricultural and poultry operations, a need exists to make such systems simpler in construction, and more economical and efficient in use. These goals can be achieved by a cooling pad support assembly which is:

1. easier to assemble;
2. easier to inspect and clean;
3. more efficient in promoting vaporization;

4. more constant and more uniform in inducing flow of water through the vaporization area;
5. more capable of facilitating an increase in the vaporization area height or length; and
6. more complete in insuring saturation of the top of the cooling pad.

SUMMARY

A cooling pad support system for holding a cooling pad may include a support array; a pivoting platform configured to be pivotably connected with respect to the support array and a support finger configured to be pivotably connected to the pivoting platform.

The cooling pad may be sandwiched between the support finger and support array.

The support finger includes an inclined section.

The support finger may include a vertical section.

The pivoting platform may include a longitudinal arm.

The longitudinal arm may include a loop section to connect to the support finger.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
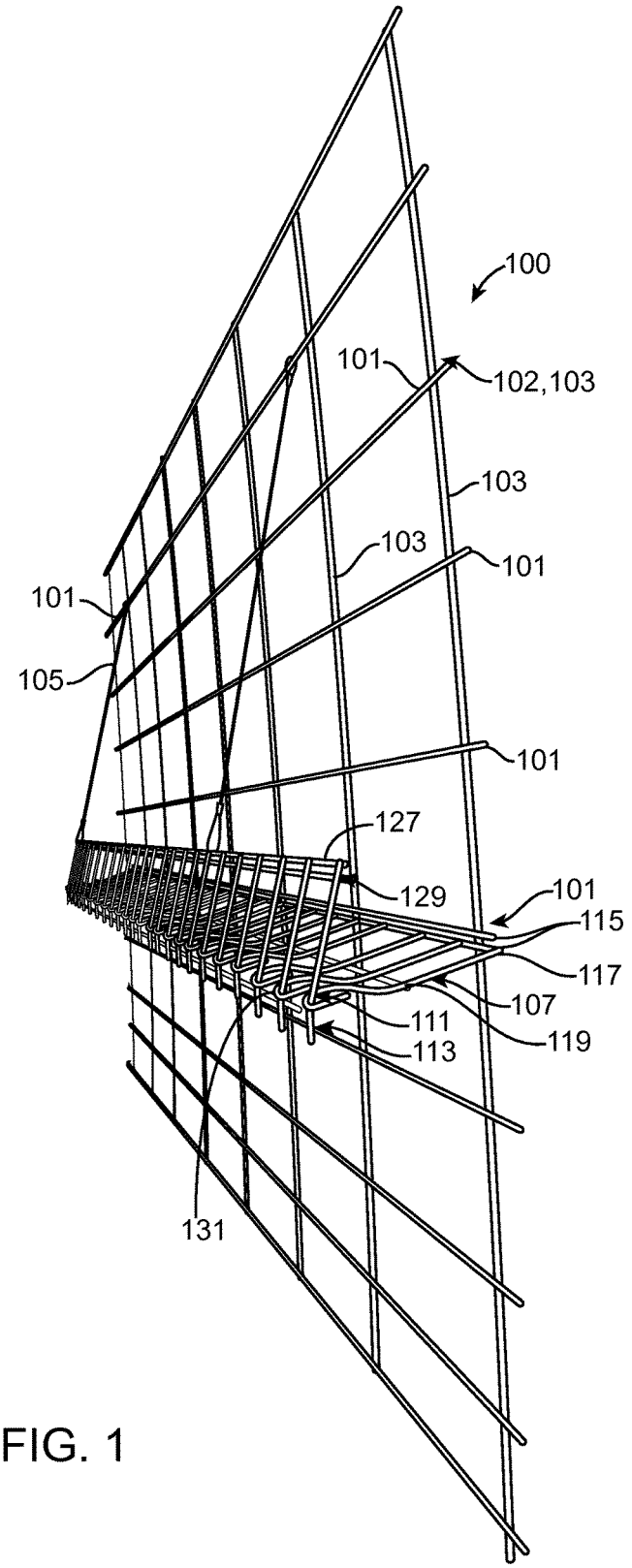
FIG. 1 illustrates a perspective view of a cooling pad support system in accordance with the present invention.

FIG. 1 illustrates a perspective view of a cooling pad support system 100 which may be used to support a cooling pad (not shown) which may include a support array 102 to form a support platform 103 which may include horizontal support arms 101 and vertical support arms 105 which may be rigidly connected to the horizontal support arms 101 by welding, bolts or other appropriate fasteners. The platform 103 may be formed from rigid material. The horizontal support arms 101 may extend in the horizontal direction and may extend the substantially width of the support platform 103 and the vertical support arms 105 may extends in the substantial vertical direction and may extend the substantially height of the support platform 103 to form a grid. The support platform 103 may provide a back wall/platform for the cooling pads which may be treated with a fluid such as water in order to provide economical cooling for a structure (not shown). The height and the width of the support platform 103 may be varied in order to support different sizes of cooling pads.

FIG. 1 additionally illustrates a pivoting platform 107 which may include a plurality of longitudinal arms 109 which may extend outwards from the support platform 103 and which may terminate at one end with a loop section 111 to form a pivoting connection by a connector 113 which may be a ring. A first longitudinal arm 109 may be substantially parallel to a second longitudinal arm 109. The platform 107 may be formed from rigid material.

The plurality of longitudinal arms 109 may be rigidly connected to a first connecting cross arm 115 which may extend substantially perpendicular to the longitudinal arms 109 and may be rigidly connected to a second connecting cross arm 117 which may extend substantially perpendicular to the longitudinal arms 109. Additionally, FIG. 1 illustrates a third connecting cross arm 119 which may be essentially parallel to the second connecting cross arm 117.

The connector ring 113 may extend around the first cross connecting arms 115 and may extend around the horizontal support arm 101 in order to form a pivoting connection between the support platform 103 and the pivoting platform 107.

FIG. 1 additionally illustrates a multitude of support fingers 121 to support the evaporative pads by forming a sandwich like effect by holding the evaporative pads between the support fingers 121 and the support platform 103. The support fingers 121 maybe formed from rigid material and may include an inclined section 123 and a vertical section 125. The support fingers 121 such as a first support finger 121 and a second support finger 125 may be rigidly connected by a first cross finger arm 127, a second cross finger arm 129 a third cross finger arm 131 and may be formed from rigid material, and the arms 127, 129, 131 may be formed from rigid material.

The support fingers 121 may be pivotably connected to the pivoting platform 107, more particularly the support fingers 121 may be pivotably connected to the loop 111 of the longitudinal arm 109.

FIG. 1 illustrates a flexible cable 131 which may be connected to the support platform 103 and may be connected to the first cross finger arm 127.

Figure 2:
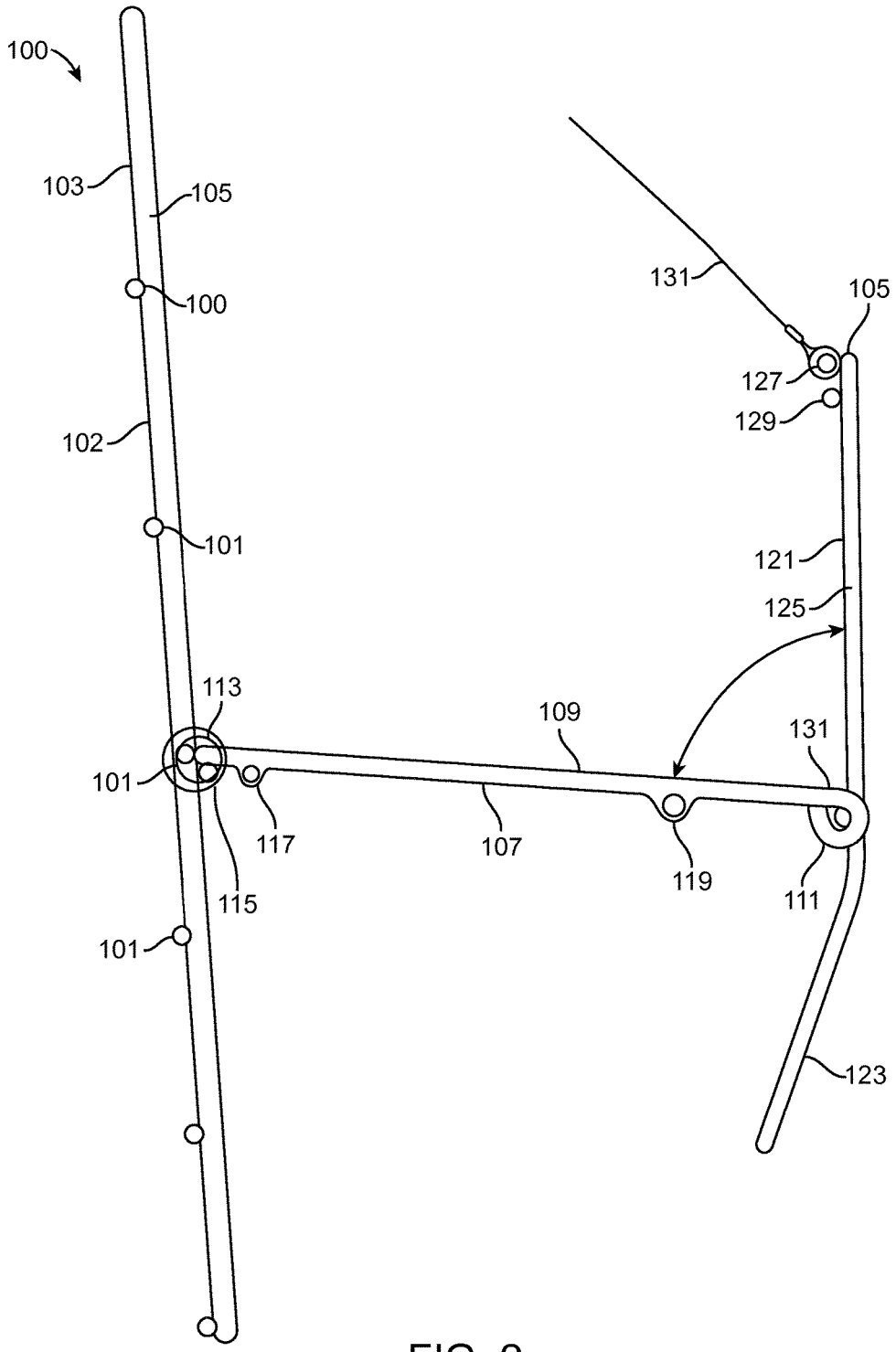
FIG. 2 illustrates a side view of the cooling pad support system in accordance with the present invention.

FIG. 2 illustrates a side view of a cooling pad support system 100 in an open position which may be used to support a cooling pad (not shown) which may include a support array 102 to form a support platform 103 which may include horizontal support arms 101 and vertical support arms 105 which may be rigidly connected to the horizontal support arms 101 by welding, bolts or other appropriate fasteners. The platform 103 may be formed from rigid material. The horizontal support arms 101 may extend in the horizontal direction and may extend the substantially width of the support platform 103 and the vertical support arms 105 may extends in the substantial vertical direction and may extend the substantially height of the support platform 103 to form a grid. The support platform 103 may provide a back wall/platform for the cooling pads which may be treated with a fluid such as water in order to provide economical cooling for a structure (not shown). The height and the width of the support platform 103 may be varied in order to support different sizes of cooling pads.

FIG. 2 additionally illustrates a pivoting platform 107 which may include a plurality of longitudinal arms 109 which may extend outwards from the support platform 103 and which may terminate at one end with a loop section 111 to form a pivoting connection by a connector 113 which may be a ring. A first longitudinal arm 109 may be substantially parallel to a second longitudinal arm 109. The platform 107 may be formed from rigid material.

The plurality of longitudinal arms 109 may be rigidly connected to a first connecting cross arm 115 which may extend substantially perpendicular to the longitudinal arms 109 and may be rigidly connected to a second connecting cross arm 117 which may extend substantially perpendicular to the longitudinal arms 109. Additionally, FIG. 2 illustrates a third connecting cross arm 119 which may be essentially parallel to the second connecting cross arm 117.

The connector ring 113 may extend around the first cross connecting arm 115 and may extend around the horizontal support arm 101 in order to form a pivoting connection between the support platform 103 and the pivoting platform 107.

FIG. 2 additionally illustrates a multitude of support fingers 121 to support the evaporative pads by forming a sandwich like effect by holding the evaporative pads between the support fingers 121 and the support platform 103. The support fingers 121 maybe formed from rigid material and may include an inclined section 123 and a vertical section 125. The support fingers 121 such as a first support finger 121 and a second support finger 125 may be rigidly connected by a first cross finger arm 127, a second cross finger arm 129 a third cross finger arm 131 and may be formed from rigid material, and the arms 127, 129, 131 may be formed from rigid material.

The support fingers 121 may be pivotably connected to the pivoting platform 107, more particularly the support fingers 121 may be pivotably connected to the loop 111 of the longitudinal arm 109.

FIG. 2 illustrates a flexible cable 131 which may be connected to the support platform 103 and may be connected to the first cross finger arm 127.

Figure 3:
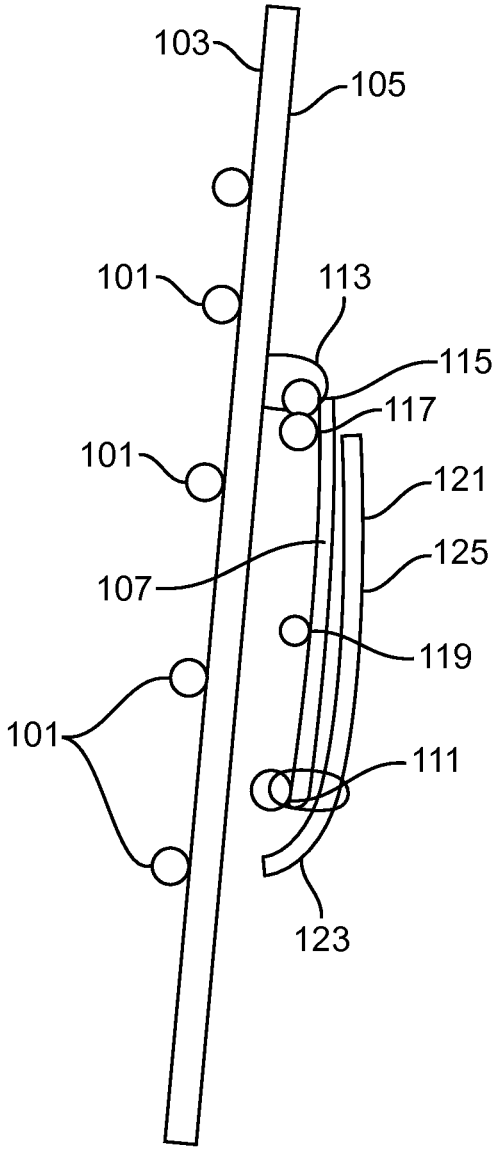
FIG. 3 illustrates a side view of the present invention.

FIG. 3 illustrates a side view of a cooling pad support system 100 in a closed position which may be used to support a cooling pad (not shown) which may include a support array 102 to form a support platform 103 which may include horizontal support arms 101 and vertical support arms 105 which may be rigidly connected to the horizontal support arms 101 by welding, bolts or other appropriate fasteners. The platform 103 may be formed from rigid material. The horizontal support arms 101 may extend in the horizontal direction and may extend the substantially width of the support platform 103 and the vertical support arms 105 may extends in the substantial vertical direction and may extend the substantially height of the support platform 103 to form a grid. The support platform 103 may provide a back wall/platform for the cooling pads which may be treated with a fluid such as water in order to provide economical cooling for a structure (not shown). The height and the width of the support platform 103 may be varied in order to support different sizes of cooling pads.

FIG. 3 additionally illustrates a pivoting platform 107 which may include a plurality of longitudinal arms 109 which may extend outwards from the support platform 103 and which may terminate at one end with a loop section 111 to form a pivoting connection by a connector 113 which may be a ring. A first longitudinal arm 109 may be substantially parallel to a second longitudinal arm 109. The platform 107 may be formed from rigid material.

The plurality of longitudinal arms 109 may be rigidly connected to a first connecting cross arm 115 which may extend substantially perpendicular to the longitudinal arms 109 and may be rigidly connected to a second connecting cross arm 117 which may extend substantially perpendicular to the longitudinal arms 109. Additionally, FIG. 1 illustrates a third connecting cross arm 119 which may be essentially parallel to the second connecting cross arm 117.

The connector ring 113 may extend around the first cross connecting arms 115 and may extend around the horizontal support arm 101 in order to form a pivoting connection between the support platform 103 and the pivoting platform 107.

FIG. 3 additionally illustrates a multitude of support fingers 121 to support the evaporative pads by forming a sandwich like effect by holding the evaporative pads between the support fingers 121 and the support platform 103. The support fingers 121 maybe formed from rigid material and may include an inclined section 123 and a vertical section 125. The support fingers 121 such as a first support finger 121 and a second support finger 121 may be rigidly connected by a first cross finger arm 127, a second cross finger arm 129 a third cross finger arm 131 and may be formed from rigid material, and the arms 127, 129, 131 may be formed from rigid material.

The support fingers 121 may be pivotably connected to the pivoting platform 107, more particularly the support fingers 121 may be pivotably connected to the loop 111 of the longitudinal arm 109.

FIG. 3 illustrates a flexible cable 131 which may be connected to the support platform 103 and may be connected to the first cross finger arm 127.

Figure 4:
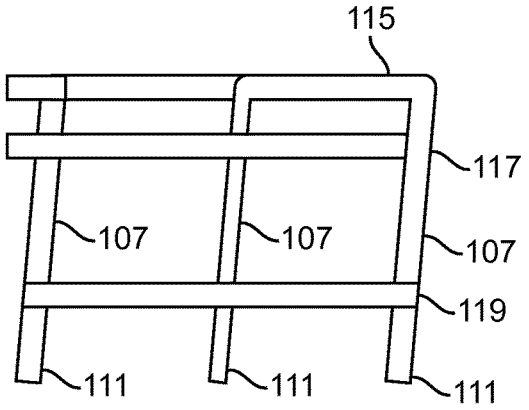
FIG. 4 illustrates a front view of the present invention.

FIG. 4 illustrates a front view of the pivoting platform 107 and illustrates the support fingers 121, the connecting cross arm 117, the connecting cross arm 115 and the connecting cross arm 119. FIG. 4 additionally illustrates the loop section 111 of the pivoting platform 107.

Figure 5:
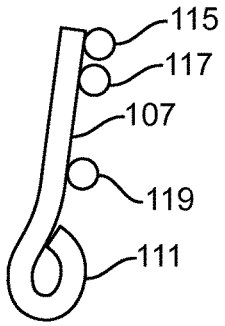
FIG. 5 illustrates a side view of the present invention.

FIG. 5 illustrates a side view of the pivoting platform 107 and illustrates the support fingers 121, the connecting cross arm 117, the connecting cross arm 115 and the connecting cross arm 119. FIG. 5 additionally illustrates the loop section 111 of the pivoting platform 107.

Figure 6:
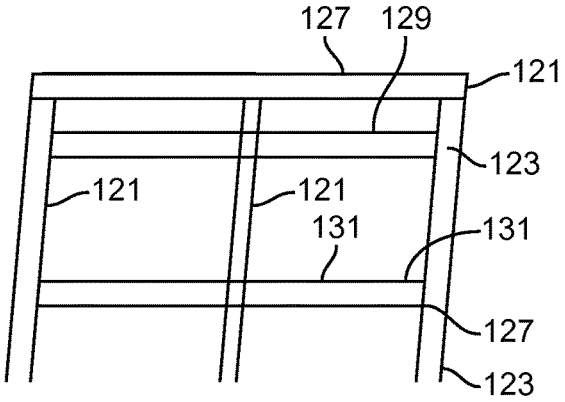
FIG. 6 illustrates a front view of the present invention.

FIG. 6 illustrates a front view of the plurality of support fingers 121 which may include an inclined section 123 and a vertical section 125.

The support fingers 121 such as a first support finger 121 and a second support finger 121 may be rigidly connected by a first cross finger arm 127, a second cross finger arm 129 a third cross finger arm 131 and may be formed from rigid material, and the arms 127, 129, 131 may be formed from rigid material.

The support fingers 121 may be pivotably connected to the pivoting platform 107, more particularly the support fingers 121 may be pivotably connected to the loop 111 of the longitudinal arm 109.

The support fingers 121 such as a first support finger 121 and a second support finger 121 may be rigidly connected by a first cross finger arm 127, a second cross finger arm 129 a third cross finger arm 131 and may be formed from rigid material, and the arms 127, 129, 131 may be formed from rigid material.

The support fingers 121 may be pivotably connected to the pivoting platform 107, more particularly the support fingers 121 may be pivotably connected to the loop 111 of the longitudinal arm 109.

Figure 7:
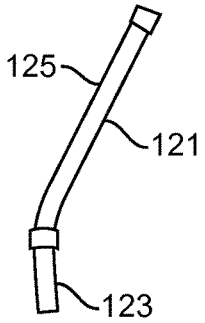
FIG. 7 illustrates a side view of the present invention.

FIG. 7 illustrates a side view of the plurality of support fingers 121 which may include an inclined section 123 and a vertical section 125.

Figure 8:
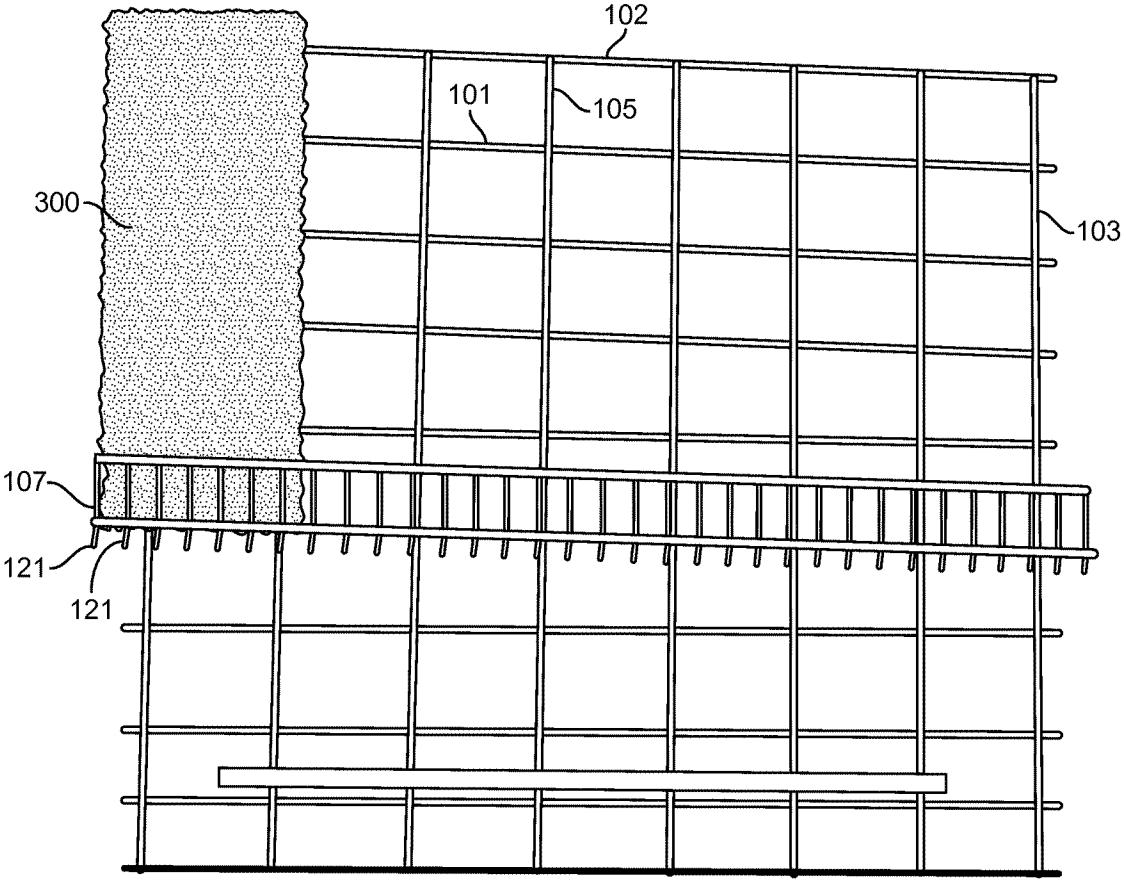
FIG. 8 illustrates a view of the present invention.

FIG. 8 illustrates a cooling pad 300 being supported and being sandwiched between the support array 102 and the pivoting platform 107.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A cooling pad support system for holding a cooling pad, comprising:

a support array;

a pivoting platform configured to be pivotably connected with respect to the support array;

a support finger configured to be pivotably connected to the pivoting platform;

wherein the cooling pad is sandwiched between the support finger and support array wherein the support finger includes a inclined section positioned below the pivoting platform and a vertical section positioned above the pivoting platform and wherein the support finger is connected to the support array by a flexible cable.

2. A cooling pad support system for holding a cooling pad as in claim 1, wherein the pivoting platform includes a longitudinal arm.

3. A cooling pad support system for holding a cooling pad as in claim 2, wherein the longitudinal arm includes a loop section to connect to the support finger.

* * * * *